US005211573A

United States Patent [19]

Cross

[11] Patent Number: 5,211,573

[45] Date of Patent: May 18, 1993

[54] ELECTRICAL CORD COUPLING

[76] Inventor: Andrew L. Cross, 17774 Ravenna Rd., Mantua, Ohio 44255

[21] Appl. No.: 895,135

[22] Filed: Jun. 8, 1992

Related U.S. Application Data

[63] Continuation-in-part of Ser. No. 815,750, Jan. 2, 1992.

[51] Int. Cl.[5] ..... H01R 13/62

[52] U.S. Cl. ..... 439/369; 439/373

[58] Field of Search ..... 439/345, 367, 368, 369, 439/370, 371, 373

[56] References Cited

U.S. PATENT DOCUMENTS

| | | | |
|---|---|---|---|
| 3,030,601 | 4/1962 | Krebs | 439/369 |
| 3,708,778 | 1/1973 | McKeever | 439/371 X |
| 3,781,761 | 12/1973 | Harwood | 439/369 |
| 4,183,603 | 1/1980 | Donarummo | 439/369 |
| 4,221,449 | 9/1980 | Shugart, Jr. | 439/369 |
| 4,504,106 | 3/1985 | Fechter | 439/369 X |
| 4,643,505 | 2/1987 | House et al. | 439/369 |
| 4,664,463 | 5/1987 | Carmo | 439/369 |

*Primary Examiner*—Larry I. Schwartz
*Assistant Examiner*—Khiem Nguyen
*Attorney, Agent, or Firm*—John F. McDevitt

[57] ABSTRACT

A method and means are provided to retain locked engagement for the plug end of an electrical cord. A coupling device is provided enabling the user to retain locking engagement for the electrically connected cord during ordinary usage.

15 Claims, 3 Drawing Sheets

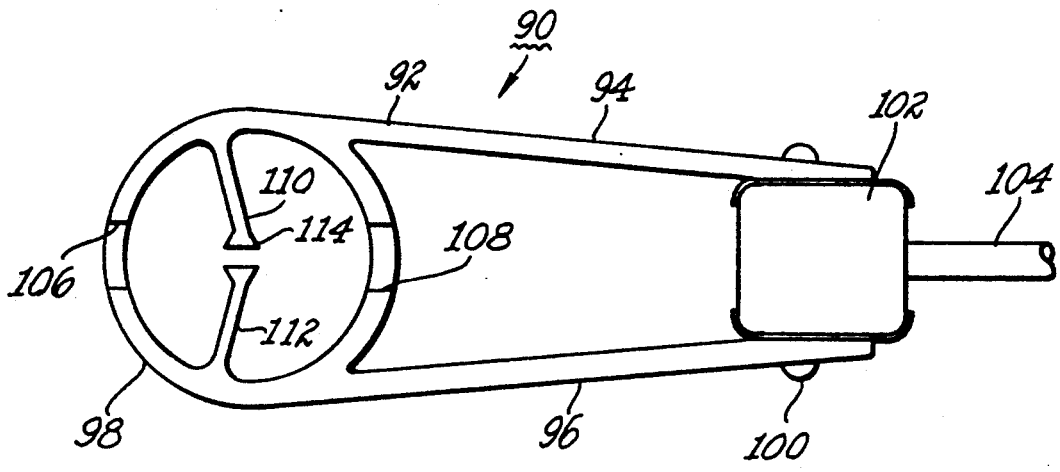
Fig. 3
Fig. 4
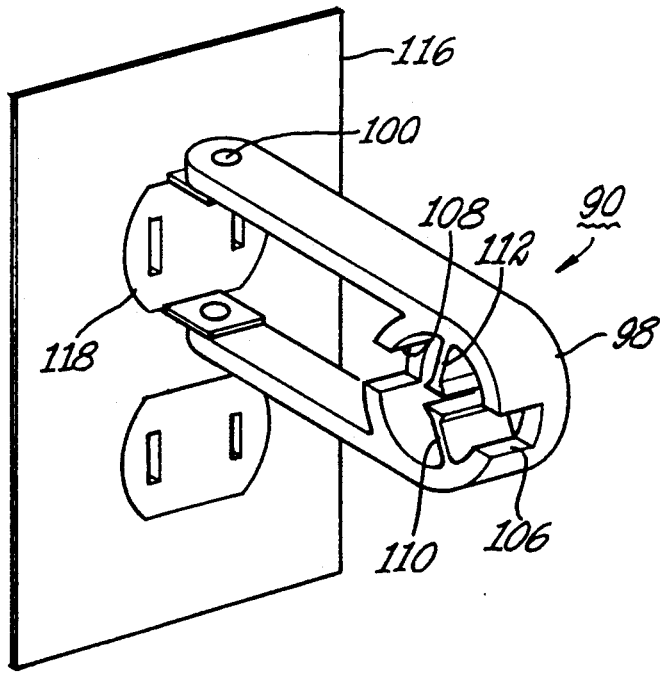

ELECTRICAL CORD COUPLING

This is a continuation-in-part of application Ser. No. 07/815,750 filed Jan. 2, 1992.

BACKGROUND OF THE INVENTION

This invention relates generally to coupling means enabling the plug end of an electrical cord to retain locked engagement with mating electrical connection means and more particularly to a coupling device preventing accidental separation of the electrically connected cord plug during ordinary usage.

Various coupling means are already known whereby electrical cords provided with mating male and female plugs at one end can be held together during normal use. In one manner of coupling, there is disclosed in U.S. Pat. No. 4,917,625 an electrical connector device to be interposed between male and female plugs provided upon the ends of electrical cords. The connector includes springable arms having shoulders interengaging with shoulders formed on the adjacent ends of the plugs, in such fashion as to lockably engage the plugs and thereby prevent separation of the cords during use. Within the connector there is said to be provided electrical connector elements each having a female and a male end, adapted to mate with the electrical elements of the plugs, thus providing a thru electrical connection for the cords, while assuring that they will be held together against inadvertent separation. In another embodiment, the provision of electrical elements within the connecting device itself is omitted and instead, a yoke or retainer, usable in both embodiments has its spring arms against engaging shoulders on the plugs, with the plugs in this instance interengaging directly as well as being releasably, lockably engaged with the retainer. In a different manner of securing the connected plug ends from accidental separation during ordinary usage, there is disclosed in U.S. Pat. No. 4,917,626 coupling means holding the male and female plugs of a power tool and an extension Cord. A strap of interlocking "hook" material such as a Velcro heavy-duty hook type fastener, is said to be adhered to either side of the male plug, the straps extending longitudinally past the face of the plug approximately two inches. A pad of interlocking "loop" materials, such as a Velcro heavy-duty loop-type fastener is adhered to either side of the female plug so as to face the straps when the plugs are engaged, whereupon the straps may be pressed into interlocking engagement with the pads. The thus engaged two plugs are said to not to be easily pulled apart during usage yet are readily detached by a user when wishing to disconnect the engaged plugs. In a similar commercially available coupling means, metal hooks required to be secured by a user to both extension cord and power tool cord are engaged to prevent an accidental separation of the connected plug ends. It has now been found that a novel single-piece coupling device of unitary construction enables such user to more readily affix the connected electrical cords thereto in a manner less susceptible to accidental separation as well as provides a more versatile means to retain locked engagement for the plug end of a single electrical cord which has been connected by such user to other type mating electrical connection means such as service outlets and the like.

It is an object of the present invention, therefore, to provide improved coupling means retaining electrical connection for the plug end of an electrical cord after having been connected to mating electrical connection means.

It is another object of the present invention to provide a novel single-piece coupling device having friction-fit retention means for at least one electrical cord.

A still further object of the present invention is to provide such coupling device with friction-fit retention means further exerting a restraining force against having an electrical cord being released therefrom.

Another object of the present invention is to provide a particular physical form of said novel single-piece coupling device suitable for attachment to the plug end of an electrical cord as well as various service outlets therefor.

Still another object of the present invention is to provide a novel single-piece coupling device with a plurality of retention means preventing physical separation between a pair of already connected electrical cords having mating male and female plug ends.

It is still another object of the present invention to provide a novel method preventing accidental disconnection of one or more electrical cords.

These and still further objects of the present invention will become apparent upon considering the following detailed description for the present invention.

SUMMARY OF THE INVENTION

A novel coupling device has now been discovered enabling the plug end of one or more electrical cords to retain locked engagement with mating electrical connection means. Generally, said coupling device comprises a single-piece body member molded with organic polymer having a pair of spaced-apart longitudinally extending arms, integral molded retention means joining said extending arms together at least at one end, cooperating rib means provided in said retention means which project inwardly from said extending arms and further include engaging shoulders for retention of the electrical cord by friction fit, and complementary opposed openings provided in said retention means to enable passage therethrough of the electrical cord. Such entire device can be formed with either flexible thermoplastic polymer materials or rigid thermoset type polymer materials employing conventional injection or extrusion molding practices. In one physical configuration, the retention means are provided at one end of the device with the opposite end having conventional fastening means suitable for device attachment to the plug end of a single electrical cord as well as various service outlets therefor such as a wall outlet. In a different physical configuration suitable to retain a pair of male and female plugs provided at the ends of a pair of electrical cords in locked engagement, retention means are provided at opposite ends of the device so as to secure the already interconnected electrical cords therebetween. In the latter type configuration, the coupling device can have a rectangular box-like form with openings being provided at both ends enabling the connected cords to be inserted for retention of the plug ends intermediate two pair of the cooperating rib means. The preferred rib means for both above type device configurations also project forwardly from the adjoining end of the body member so as to exert a restraining force against release of the electrical cord being held.

BRIEF DESCRIPTION OF THE DRAWINGS

FIG. 3 is a top view for a coupling device of the present invention having single retention means in combination with fastening means enabling permanent joinder of said device to the plug end of an electrical cord.

FIG. 4 is a perspective view depicting the FIG. 3 coupling device being physically secured to a conventional service outlet for retention of an electrical cord connected to said outlet.

DETAILED DESCRIPTION OF THE PREFERRED EMBODIMENTS

Figure 1:
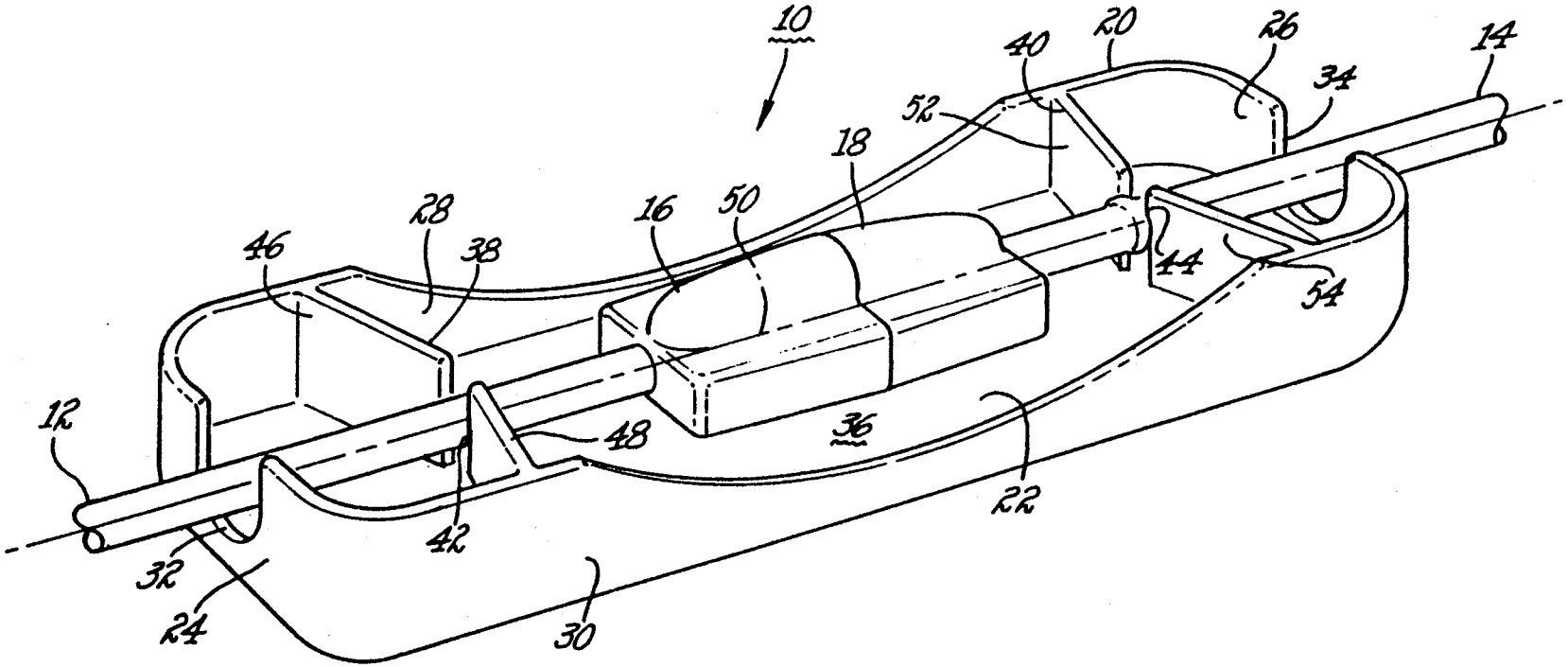
FIG. 1 is a perspective view depicting a representative coupling device of the present invention having multiple retention means being employed to retain a pair of connected electrical cords in locked engagement.

Referring to the accompanying drawings, there is depicted in FIG. 1 a perspective view for a representative coupling device of the present invention with a pair of already connected conventional electrical cords having been inserted therein by a user. Accordingly, the depicted assembly comprises a molded single-piece body member 10 formed with organic polymer so as to contain the connected electrical cords 12 and 14 in a manner preventing accidental separation during subsequent service. The illustrated electrical cords can be seen to have a male plug end 16 and a female plug end 18, respectively, so as to provide the means for physical and electrical interconnection prior to final attachment in the provided coupling device. Said device 10 has a rectangular box-like configuration 20 which includes bottom face 22, front end face 24, rear end face 26 and a pair of longer side faces 28 and 30 joining said end faces. End faces 24 and 26 have respective slot openings 32 and 34 enabling insertion of the electrical cords into the central cavity 36 provided in said device. Further retention means 38 and 40 are included in said central cavity intermediate its ends enabling a user (not shown) to simply secure the plug ends of the connected electrical cords therebetween by snap-in action. More particularly, said retention means each include semi-circular shaped shoulders 42 and 44, respectively, which engage the electrical cords when inserted therein and thereafter retain the inserted cords in place by friction fit. Retention means 38 comprises a pair of rib-like elements 46 and 48 projecting inwardly from the side faces of central cavity 36 and intersecting along the longitudinal center axis 50 of the coupling device. As can also be seen, the engaging shoulder portions 42 provided in said retention means has been optionally located at the point of intersection for the cooperating rib-like elements 46 and 48. It can be further noted in the present drawing that said retention means 38 projects forwardly from adjoining front end face 24 of the connector device thereby providing a means of strain relief to resist any mechanical forces being exerted along the center axis 50 of the coupling device and affixed electrical cords which tend to disengage the latter. In a corresponding manner, the remaining retention means 40 comprises rib-like elements 52 and 54 extending from the side faces and intersecting at engaging shoulder portions 44 while further projecting forwardly from adjoining rear end face 26. This, a cooperative effort can take place with the illustrated retention means to provide a restraining force against having the affixed electrical plug ends being thereafter pulled apart during customary use. While such desired cooperation occurs in the illustrated embodiment when molded with either thermoplastic or thermoset type polymer materials, it is contemplated that generally greater flexibility ordinarily imparted with thermoplastic polymers can provide still further desirable spring back action.

Ability to form the above described Coupling device entirely by means of a single injection molding step affords still other significant advantages. Manufacturing costs can thereby be reduced since low-cost conventional polymer materials can be employed while parts assembly is avoided. Having the connected electrical cords enveloped by container means avoids physical and electrical damage occurring at the plug ends during usage with the sealed bottom further provided in said containment means reducing physical contact of the plug ends with any surface water or Other deleterious liquids encountered during use. Utilization of the described coupling device also proceeds in a distinctive manner. A user simply connects the mating plug ends of the electrical cord together followed by inserting the interconnected cords into the end openings provided in the body member. To complete the clamping engagement between the interconnected cords and the coupling device only further requires a snap-in action by the user to further affix the cord in place with cooperating rib-like elements of the provided retention means.

Figure 2:
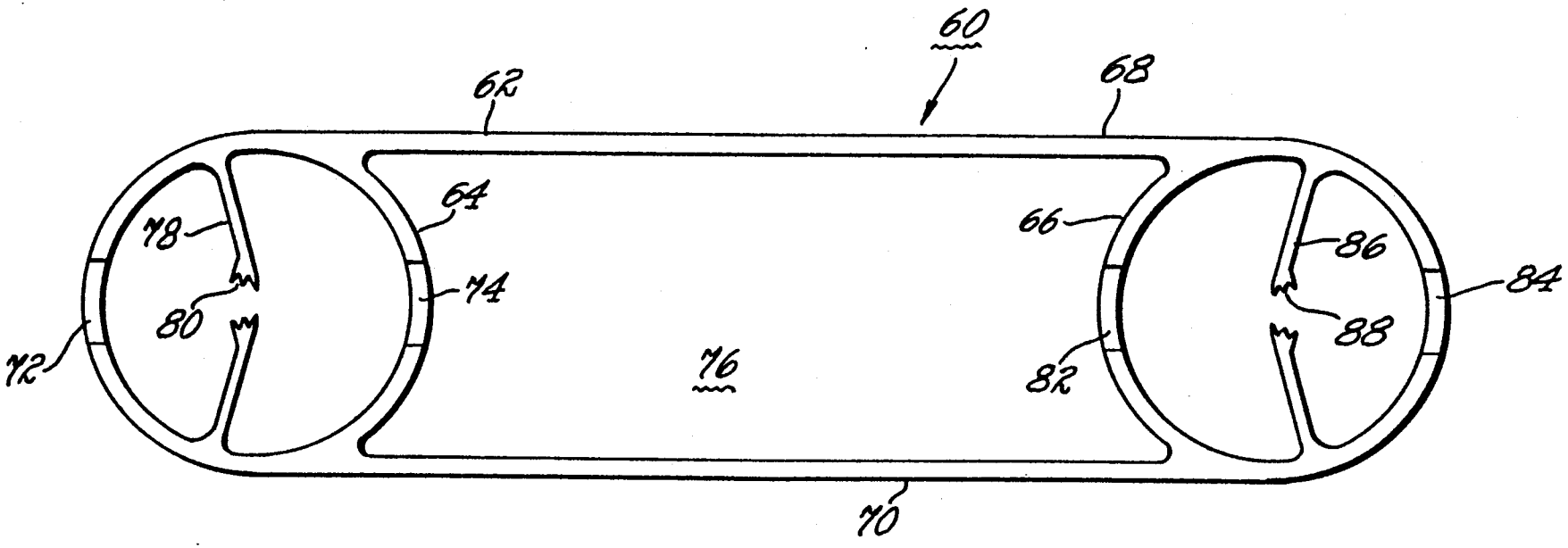
FIG. 2 is a top view for a similar type coupling device of the present invention prior to having a pair of connected electrical cords being physically secured thereto.

FIG. 2 is a top view for a different molded coupling device of the present invention prior to having the engaged cords being physically secured thereto by a user. The depicted coupling device 60 can be produced from a single molded extrusion (not shown) with a cross section as illustrated upon severing individual body members from the extruded product in a customary manner. Accordingly, such individual coupling device 60 comprises a molded single-piece body member 62 again formed with organic polymer to have a rectangular box-like configuration but which is now devoid of either top and bottom faces. Body member 62 includes rounded front end face 64 and a similarly rounded rear end face 66 being joined together with longer side faces or arms 68 and 70. Front end face 64 is cylindrically shaped having a circular cross section provided with opposed openings 72 and 74 so as to enable passage therethrough of one electrical cord (not shown) into the central cavity region 76 of the body member. A first retention means is also physically disposed within cylindrical end face 64 to further enable attachment of the cord thereat by said user employing the friction fit provided with engaging shoulders 80. Correspondingly, rear end face 66 has a like cylindrical shape provided with opposed openings 82 and 84 for passage therethrough of the remaining electrical cord (not shown) so as to have the plug ends (not shown) of the connected cord pair reside in the central cavity 76 of the body member. A second retention means 86 is likewise disposed within said cylindrical end face 66 enabling user attachment of the remaining electrical cord thereat with the provided engaging shoulders 88. As can be seen in the present drawing, having the retention means 78 and 86 of the herein illustrated coupling device being aligned about the same as employed for the preceding embodiment provides a comparable restraining force against having the affixed electrical plug ends from thereafter being pulled apart.

As hereinabove indicated, FIG. 3 is a top view for a different type coupling device of the present invention employing but single retention means to secure a locked engagement between an electrical cord and mating electrical connection means. The depicted device 90 again comprises a single-piece molded polymer body member 92 having a pair of spaced-apart longitudinally extending arms 94 and 96, integrally molded retention means 98 joining said extending arms together at one end, and conventional fastening means 100 disposed at the opposite end which attach both extending arms to the female plug end 102 of an electrical cord 104. Retention means 98 is again cylindrically shaped with opposed slot openings 106 and 108 being provided for passage therethrough of a mating electrical cord having a male plug end (not shown) to be connected to female plug end 102. Cooperating rib-like elements 110 and 112 are further included in said retention means with engaging shoulders 114 thereof enabling physical attachment of the mating electrical cord to the coupling device by friction fit. While not expressly shown in the present drawing, it can be appreciated that such physical attachment between the interconnected electrical cords is further enhanced in view of the particular retention means being employed to resist disengagement forces.

FIG. 4 depicts in perspective a further employment of the FIG. 3 coupling device 90 to retain a locked engagement when an electrical cord having a male plug end (not shown) is electrically connected to a conventional wall outlet fixture 116. Accordingly, coupling device 90 can be suitably affixed to said wall outlet fixture again with conventional fastening means 100 at a location adjacent one of the plug outlets for its subsequent utilization in the desired manner. A suitable mounting of said device astride the selected female plug outlet 118 with hinge-type fastening means 100 enables its displacement for subsequent insertion or removal of the male plug member. A user employing the herein described combination can first connect the male plug end of the cord into outlet 118 and thereafter secure the connected plug in place with retention means 98 of said coupling device. To secure the desired locking engagement simply requires inserting the now electrically connected cord into the opposed openings (106 and 108) provided with said retention means while further engaging the sides of said cord with cooperating rib elements (110 and 112). As can again be seen in the present drawing, said rib elements are physically oriented in the coupling device to exert a restraining force against having the engaged electrical cord being pulled away from the wall outlet.

It will be apparent from the foregoing description that significantly improved means have been provided to maintain continuous operation with various type electrical cords while in service. It will also be apparent that modifications can be made in the specific method and coupling means described for the illustrated embodiments without departing from the spirit and scope of the present invention. For example, modification of the retention means provided in the illustrated coupling device are contemplated such as by having the rib-like element pairs aligned perpendicular to the side faces of a body member and/or providing other structural means exerting a spring-back action in such retention means to resist forces tending to disengage an affixed electrical cord or cords. Accordingly, it is intended to limit the present invention only by the scope of the appended claims.

What I claim as new and desire to secure by Letters Patent of the United States is:

1. A coupling device to retain locked engagement for the plug end of an electrical cord with mating electrical connection means comprising:

(a) a single-piece body member molded with organic polymer having a pair of spaced-apart longitudinally extending arms, (b) integral molded retention means joining said extending arms together at least at one end, (c) cooperating rib means provided in said retention means which project inwardly from said extending arms, said rib means having a pair of rib-like elements disposed proximate to but spaced-apart from said end of the molded body member while projecting forwardly therefrom at an acute angle from a longtudinal center axis of the body member, said rib-like elements including engaging shoulders for retention of the electrical cord by friction fit, and (d) an end opening provided in said retention means and disposed rearward of said rib-like elements to enable passage therethrough of the electrical cord.

2. The device of claim 1 wherein the retention means is cylindrically shaped.

3. The device of claim 1 wherein the body member is formed with a rigid polymer.

4. The device of claim 1 wherein the body member is formed with a flexible polymer.

5. The device of claim 1 which further includes multiple pairs of cooperating rib-like elements which are aligned in opposite directions.

6. The device of claim 1 wherein fastening means are provided at the opposite end of the body member.

7. The device of claim 6 wherein the fastening means permanently secures the body member to the plug end of the electrical cord.

8. The device of claim 6 wherein the fastening means permanently secures the body member to mating electrical connection means.

9. The device of claim 1 wherein the body member includes retention means at both ends to retain a pair of connected male and female plugs provided at the ends of electrical cords.

10. The device of claim 9 wherein both retention means are cylindrically shaped.

11. A coupling device to retain a pair of male and female plugs provided at the ends of a pair of electrical cords engaged together comprising a single-piece open-ended container member molded with rigid organic polymer, the container member having a rectangular box-like configuration devoid of top and bottom faces but having a front end face and a rear end face joined together with longer side faces, both front end face and rear end face having a cylindrical shape provided with opposed openings enabling passage of the engaged cords into a central inner cavity of the container member disposed between the cylindrical end faces, and with a pair of spaced-apart integral molded retention means individually being disposed with the cylindrical end faces, the retention means each being provided with rib-like elements projecting inwardly from the side faces of the container member and further including engaging shoulders into which the engaged cords ar individually held by friction fit, and with each of said rib-like elements being formed with intersecting side portions projecting forwardly from the adjoining end face and having the engaging shoulders being located at the point of side intersection thereby providing a restraining force against having the engaged cords being pulled apart.

12. A method to retain locked engagement for an electrical cord having a plug end with mating electrical connection means which comprises:

(a) connecting the plug end of said electrical cord to said mating electrical connection means, and (b) securing the mated electrical cord and electrical connection means together with a coupling device comprising a single-piece body member of molded organic polymer having a pair of spaced-apart longitudinally extending arms, integral molded retention means joining said extending arms together at least at one end, cooperating rib means provided in said retention means which project inwardly from said extending arms, said rib means having a pair of rib-like elements disposed proximate to but spaced-apart from said end of the molded body member and projecting forwardly therefrom at an acute angle from a longitudinal center axis of the body member, said rib-like elements including engaging shoulders for retention of the electrical cord by friction fit, and an end opening in said retention means disposed rearward of said rib-like elements to enable passage therethrough of the electrical cord.

13. The method of claim 12 wherein the opposite end of said coupling device is permanently affixed to the plug end of said electrical cord.

14. The method of claim 12 wherein the opposite end of said coupling device is permanently affixed to the mating electrical connection means.

15. A method to retain locked engagement between a pair of electrical cords having mating male and female plugs at one end which comprises:

(a) connecting the electrical cords together by engagement of the mating male and female plugs, (b) inserting the engaged electrical cords into a coupling device comprising a single-piece body member of molded organic polymer having a pair of longitudinally extending arms, integral molded retention means joining said extending arms together at opposite ends, cooperating rib means provided in both retention means which project inwardly from said extending arms, each of said rib means having a pair of rib-like elements disposed proximate to but spaced-apart from said ends of the molded body member and projecting forwardly therefrom at an acute angle from a longitudinal center axis of the body member, said rib-like elements including engaging shoulders for retention of the engaged electrical cords by friction fit, and opposed end openings being provided in each retention means enabling passage therethrough of said electrical cords, and (c) securing the engaged electrical cords in place by affixing both engaged cords to the provided retention means.

* * * * *